United States Patent [19]

Imamura

[11] 4,358,980

[45] Nov. 16, 1982

[54] ELECTRONIC MUSICAL INSTRUMENT

[75] Inventor: Akio Imamura, Hamamatsu, Japan

[73] Assignee: Nippon Gakki Seizo K.K., Shizuoka, Japan

[21] Appl. No.: 139,685

[22] Filed: Apr. 14, 1980

[30] Foreign Application Priority Data

Apr. 19, 1979 [JP] Japan ..... 54-48278

[51] Int. Cl.[3] ..... G10H 1/14; G10H 5/00

[52] U.S. Cl. ..... 84/1.19; 84/1.11; 84/477 R

[58] Field of Search ..... 84/1.09-1.13, 84/1.19-1.27, 477 R

[56] References Cited

U.S. PATENT DOCUMENTS

| | | | |
|---|---|---|---|
| 3,610,799 | 10/1971 | Watson | 84/1.26 X |
| 3,897,709 | 8/1975 | Hiyoshi et al. | 84/1.19 |
| 3,935,781 | 2/1976 | Katoh et al. | 84/1.11 |
| 3,981,218 | 9/1976 | Luce | 84/1.24 |
| 3,992,969 | 11/1976 | Robinson et al. | 84/1.11 X |
| 4,106,383 | 8/1978 | Dittmar | 84/1.24 X |
| 4,176,577 | 12/1979 | Yamada et al. | 84/1.19 X |
| 4,215,618 | 8/1980 | Kamikawa | 84/1.24 X |

*Primary Examiner*—S. J. Witkowski

*Attorney, Agent, or Firm*—Blakely, Sokoloff, Taylor & Zafman

[57] ABSTRACT

In an electronic musical instrument, a plurality of component elements of a musical tone are designated by a respective plurality of manual setting elements and preset in a preset memory device. A person operating the device can select a musical tone to be produced based on the component element preset in the preset memory device or the component elements formed by the manual setting elements or any combination of such preset and manually set component elements. A visual display is used to display the amount of operation of the manual setting elements.

13 Claims, 8 Drawing Figures

ELECTRONIC MUSICAL INSTRUMENT

BACKGROUND OF THE INVENTION

This invention relates to an electronic musical instrument, more particularly an electronic musical instrument provided with a preset system, which selectively controls a musical tone in accordance with either manually operated data or preset data, and comprises a manual setting device, such elements of the musical tone to be produced as the pitch, color and volume of the tone and an effect imparted thereto, and a preset memory device adapted to prestore such elements, whereby the output of either one of these two devices is read out by a simple switching operation to readily control the musical tone.

In a prior art preset system utilizing an electronic musical instrument of the type described above, when it is desirable to manually adjust the elements of a musical tone, a switch is operated to select the output of the manual setting device. When it is desired to adjust the elements according to a preset value, the switch is operated to select the output of the preset memory device. Such preset system wherein the switch can be operated at the time of commencing performance or during performance is disclosed, for example, in Hiyoshi et al U.S. Pat. No. 3,897,709 dated Aug. 5, 1975. With such preset system, it is possible to selectively take out either the output of the manual setting device or that of the preset memory device. Furthermore, it is also possible to add the output of the manual setting device to the output of the preset memory device which is now being performed thus combining the two outputs to manually modify the preset output.

With such preset system, however, while a musical tone is being generated and performed according to the preset data set in the preset memory device, it is often desirable to perform some elements of the musical tone at a value different from the value of the preset data.

Another preset system is disclosed, for example, in John W. Robinson et al. U.S. Pat. No. 3,992,969 dated Nov. 23, 1976. With this system, combination states of tone color control switches, which are manually operated to put them into either one of ON and OFF states, are stored in a plurality of memory sets. Each of memory sets comprises a plurality of memories and in addition, a plurality of piston switches are provided in correspondence with each of the memory sets. When one of the piston switches is actuated, the corresponding memory set is selected to control the tone color of the musical tone to be produced.

SUMMARY OF THE INVENTION

Accordingly, it is the principal object of this invention to provide an improved electronic musical instrument capable of readily changing by manual operation the preset value preset in the prior art preset system to a desired value instead of the preset value while a musical tone is being performed according to the preset value.

Another object of this invention is to provide an electronic musical instrument provided with a preset system wherein the amount of component elements of a musical tone being performed presetly can be visually confirmed.

Still another object of this invention is to provide an improved electronic musical instrument with a preset system and capable of forecasting the manner of modification of a musical tone to be produced by a manually varied amount while a musical tone is being performed according to a preset value.

According to this invention, there is provided an electronic musical instrument comprising, a keyboard having a plurality of keys, a register device for storing component elements of a musical tone to be produced, a preset memory device for prestoring said component elements, means for transferring a content of said preset memory device to said register, a plurality of manual setting elements for setting the component elements of the musical tone, means for detecting the fact that one of said setting elements has been operated, means for substituting a content of said register corresponding to the component element of the operated manual setting element with a manual set value from the operated manual setting element, and means for producing a musical tone in accordance with an output of said register and a note signal sent from said keyboard.

DESCRIPTION OF THE PREFERRED EMBODIMENTS

A preferred embodiment of this invention will now be described in detail.

Figure 1:
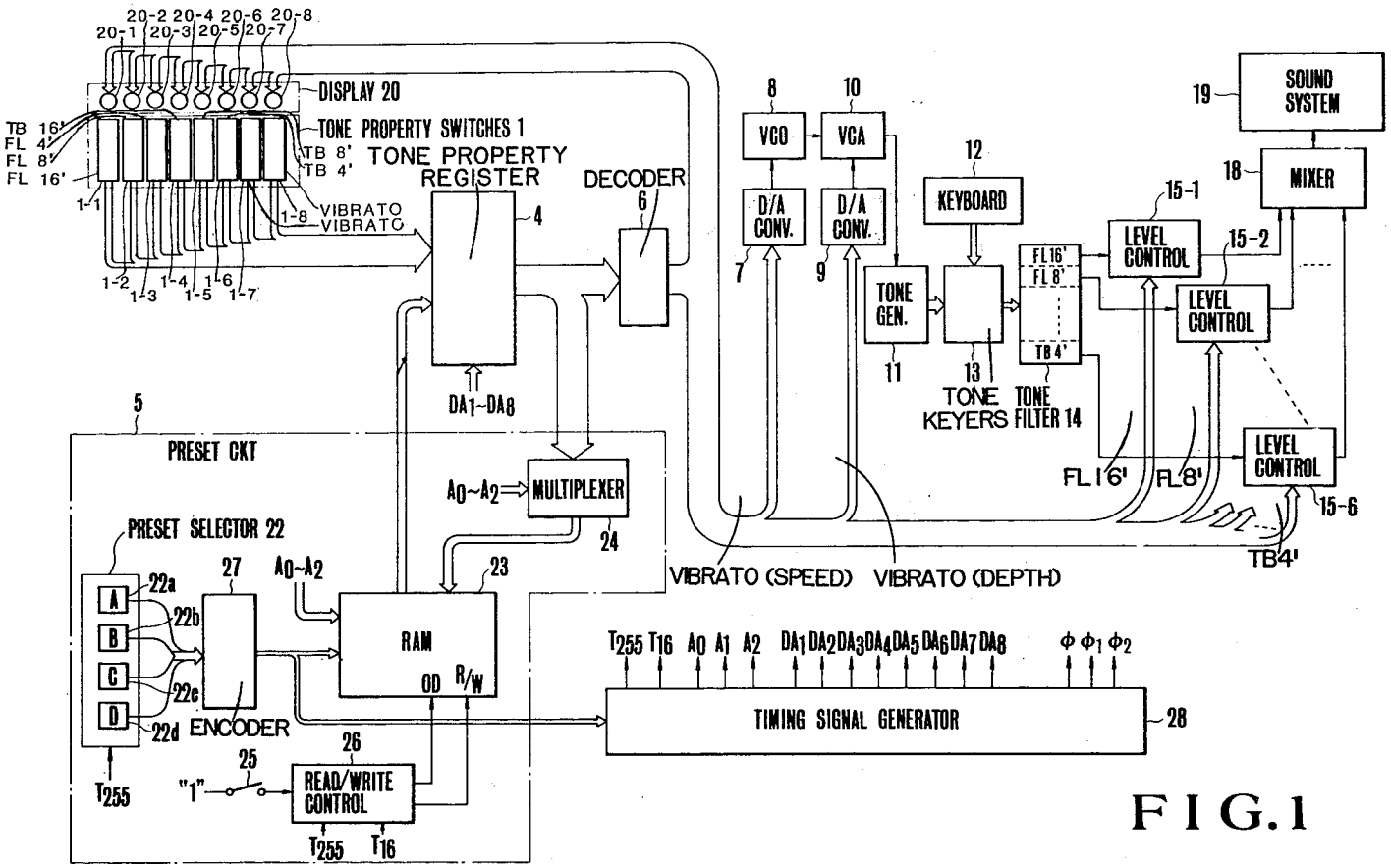
FIG. 1 is a block diagram showing one embodiment of an electronic musical instrument embodying the invention.

In the preferred embodiment of this invention shown in FIG. 1 tone property switches 1 include a plurality of switches which respectively control the pitch, color and volume of a musical tone to be generated and an effect to be imparted to the musical tone. Although in FIG. 1 only tone property switches 1-1 through 1-8 respectively controlling the tone color and speed and depth of the vibrato effect of flute 16 feet, 8 feet and 4 feet (flute 16', 8' and 4'), trombone 16', 8' and 4' are shown, it should be understood that in an actual electronic musical instrument, tone property switches different from above mentioned tone property switches are also provided for controlling the color, effect, pitch and volume of the musical tone. The purpose of the tone property switches is to control the color of the produced musical tone as well as the speed and depth of a vibrato effect. Accordingly these tone property switches are constructed to produce signals determined by the amount of operation of the operating handles thereof. Since all tone property switches have the same construction, only the tone property switch 1-1 will be described in detail with reference to FIG. 2. As shown, the tone property switch 1-1 comprises 15 switch contacts 2 (201 through 215) which are disposed linearly or circularly. Normally these switch contacts, each of which restores to the original state automatically except for operational force, are all opened and closed sequentially depending upon the amount of manual operation, and signals corresponding to the amount of the operation are converted into 4-bit signals (hereinafter termed as manually operated signals) by an encoder 3 and then applied to a tone property register 4 which is also supplied with tone property data (hereinafter termed as preset data) which have been preset in a preset circuit 5, which is preset with a number of set of data regarding the amount of operation of the tone property switches 1-1 through 1-8 so that a set of data can be read out by a simple switching operation of the performer as will be described in detail later. The tone property register 4 is constructed to preferentially store the manually operated data instead of the preset data from the preset circuit 5 according to the following conditions from the tone property switches 1-1 through 1-8.

(A) When the preset data are not read out from the preset circuit 5, the tone property register 4 holds the manually operated data from the tone property switches 1. (B) When the preset data are read out from the preset circuit 5, the register holds these data. (C) When the tone property switches 1-1 through 1-8 are operated while the preset data are being maintained, the register holds only the output signal from the operated switch.

Turning back again to FIG. 1, a timing signal generator 28 contains a reference oscillator, not shown, which produces a reference clock pulse $\phi$ and pulses $\phi 1$ and $\phi 2$, pulses $\phi$ and $\phi 2$ having a phase difference of 180° from pulse $\phi 1$ and various timing pulses T16, T225, A0 through A2, $D_{A1}$ through $D_{A8}$ which are used to read or write preset data in synchronism with the reference clock $\phi$. The data held in the tone property register 4 are decoded by a decoder 6 and used to control the tone color and effects, etc.

A data produced by the decoder 6 and representing the speed of the vibrato is applied to a voltage-controlled oscillator (VCO) 8 for vibrato via a digital to analogue converter 7 to control the oscillation frequency of the oscillator. A data regarding the depth of the vibrato is applied to the control input of a voltage-controlled amplifier (VCA) 10 through a digital to analogue converter 9 (VCA) 10 to control the gain of the VCA 10 which is also supplied with the output of the VCO 8 so that the VCA 10 produces a vibrato signal having a predetermined frequency (several Hz, for example) and a predetermined amplitude. The vibrato signal produced by the VCA 10 is applied to a tone generator 11 comprising a tone source (oscillator) and a plurality of frequency dividers (both not shown) for producing tone source signals, for example 16 feet, 8 feet and 4 feet corresponding to respective keys. The vibrato signal is applied to the tone source (for example a VCO) to control its oscillation frequency. As a consequence, the tone generator 11 produces a tone source signal applied with a vibrato effect having a predetermined speed (frequency) and a predetermined depth.

Figure 3:
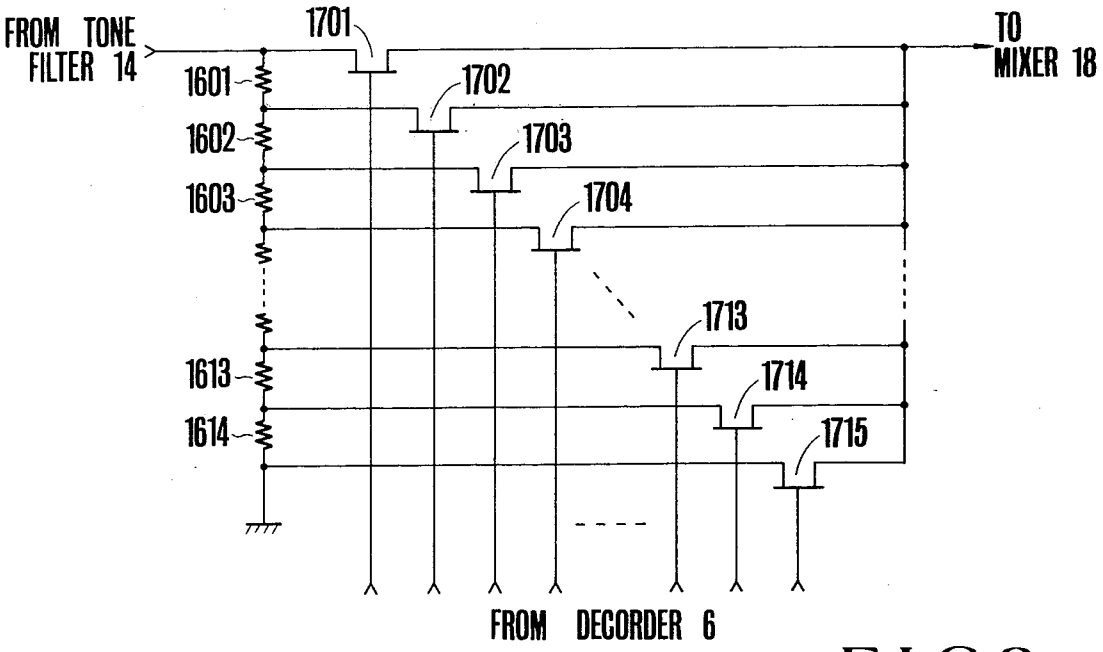
FIG. 3 is a connection diagram showing one example of the level control circuit shown in FIG. 1.

The tone source signals produced by the tone generator 11 are applied to a tone keyers 13 which selects only the tone source signals corresponding to the depressed keys of a keyboard 12 and the selected signals are applied to tone filter 14 which comprises tone color filters imparting tone colors (flute 16', 8', 4' and trombone 16', 8', 4') corresponding to respective switches 1-1 through 1-6) of the tone property switch 1 thus imparting respective colors to the inputted tone source signals. Level control circuits 15-1 through 15-6 are provided on the output sides of the tone filter 14. The level control circuits 15-1 to 15-6 control the levels of the musical tone signals having respectively tone colors (flute 16', . . . , trombone 4') in accordance with the output of the tone property register, that is the above described preset data or manually operated data. Each of the level control circuit 15-1 to 15-6 is constituted by a voltage divider comprising a plurality of serially connected resistors 1601 to 1614 as shown in FIG. 3. Either one of 15 FET switches 1701 through 1715 respectively connected to the junctions of the resistive voltage divider is turned on by a signal from the decoder 6 to adjust the musical tone signal applied from the tone filter 14 to have a predetermined level. For example where the amount of operation of the tone property switches 1 shown by the output data of the tone property register 4 is small, a low order FET switch is turned on to produce a musical tone signal having a low level. When the amount of control is zero, none of the FET switches are turned on so that no musical tone signal is produced. As the amount of control increases, a high order FET switch is turned on to produce a musical tone signal at a high level. The digital to analogue converters 7 and 9 may may comprise a resistive voltage divider as shown in FIG. 3.

Musical tone signals having respectively various tone colors with their levels having been adjusted by level control circuits 15-1 through 15-6 are synthesized by a mixer 18 and then supplied to a sound system 19 to produce a musical tone having a tone color and an effect corresponding to the preset data or manually controlled data.

The signal produced by the decoder 6 is also applied to a display 20 which displays the values of the data held in the tone property register 4 (The values correspond to the amount of operation of the tone property switches 1-1 through 1-8). For example, the display 20 comprises lamps 20-1 through 20-8 respectively corresponding to the switches 1-1 through 1-8 of the tone property switch circuit 1. Respective lamps 20-1 through 20-8 are constituted by 15 LEDs (light emitting diodes) 2101 through 2115 connected to respective output lines of the decoder 6 so that a LED being in position corresponding to the value of the data held in the tone property register 4 lights. For example, when no preset data is read out, the amounts of operation of the switches 1-1 to 1-8 of the tone property switches 1 are displayed, and while the preset data are being read out when some of the switches 1-1 through 1-8 are operated, the manually operated amounts thereof are displayed instead of the preset data corresponding to the manually operated switches. For this reason, the performer can accurately know the color, effect and other effects of the musical tone presently set.

Let us now describe the detail of the tone property register 4, the preset circuit 5 and the timing signal generator 28.

Firstly, the preset circuit 5 will be described. The preset circuit 5 shown in FIG. 1 is constructed such that four states regarding the amount of operation of the tone property switches 1-1 through 1-8 can be preset, and a memory device (RAM) 23 is provided for storing the amount of control. In the embodiment shown in FIG. 1 the data from the tone property register 4 are preset in the RAM. A multiplexer 24 is provided to multiplex the output data of the tone property register 4 and then applies the multiplexed data to the memory device 23, and a read/write control circuit 26 writes the multiplexed data into the memory device 23 in accordance with a signal "1" supplied from a write switch 25 which is closed by the performer. The preset circuit 5 can be preset 4 states described above. To this end, the memory device 23 is provided with four storage areas. The preset selector 22 selects one of the storage areas when reading or writing is made. More particularly the preset selector 22 is provided with four preset selection switches 22*a* through 22*d*. When the performer closes one of these switches, a signal corresponding to this switch is applied to the memory device 23 via an encoder 27 to act as an address signal. By said above described data, writing into or reading out from a storage area of the memory device corresponding to the closed switch of the preset selector 22 is requested.

Figure 4:
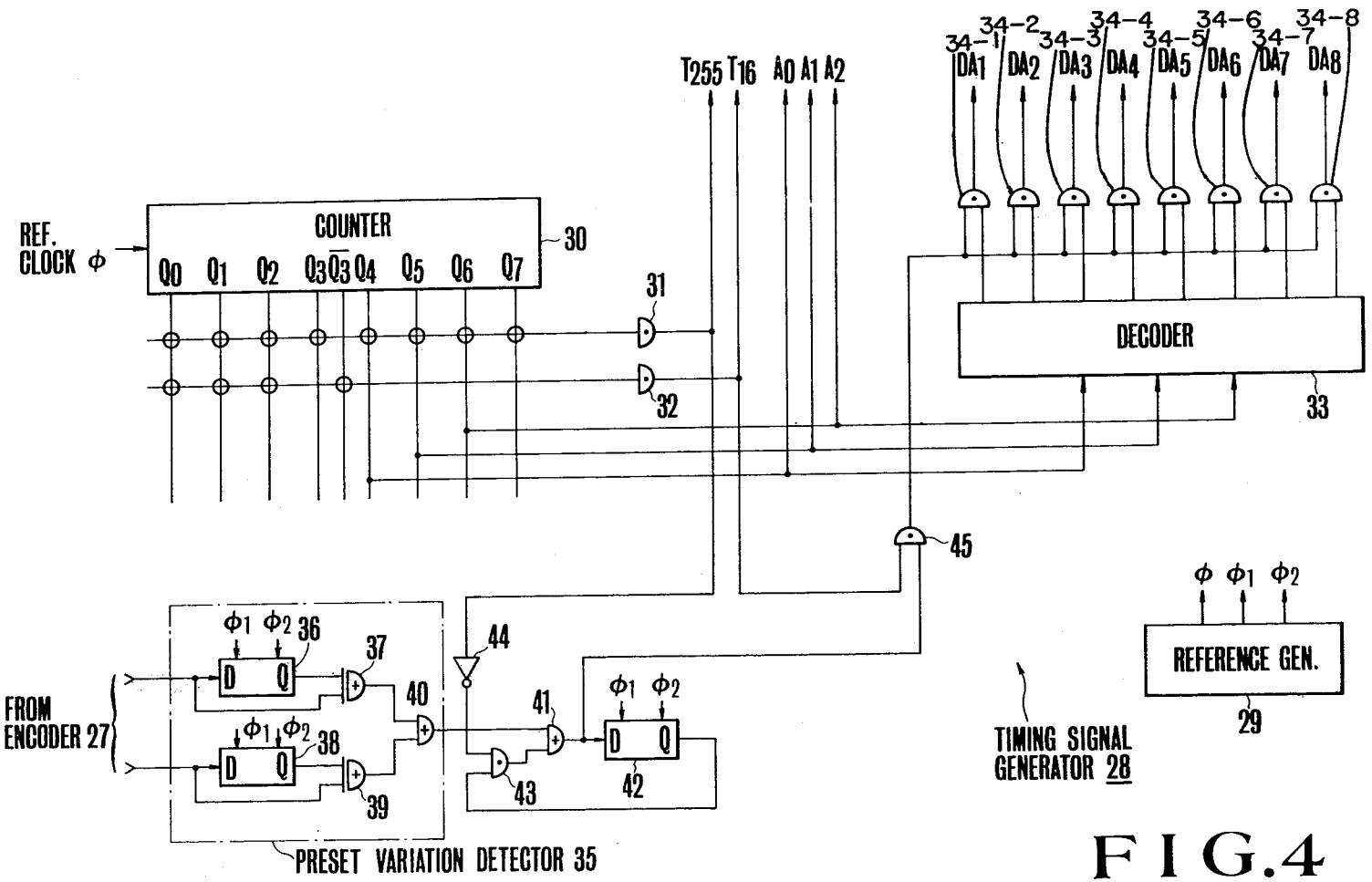
FIG. 4 is a connection diagram showing one embodiment of the timing signal generator shown in FIG. 1.
Figure 6:
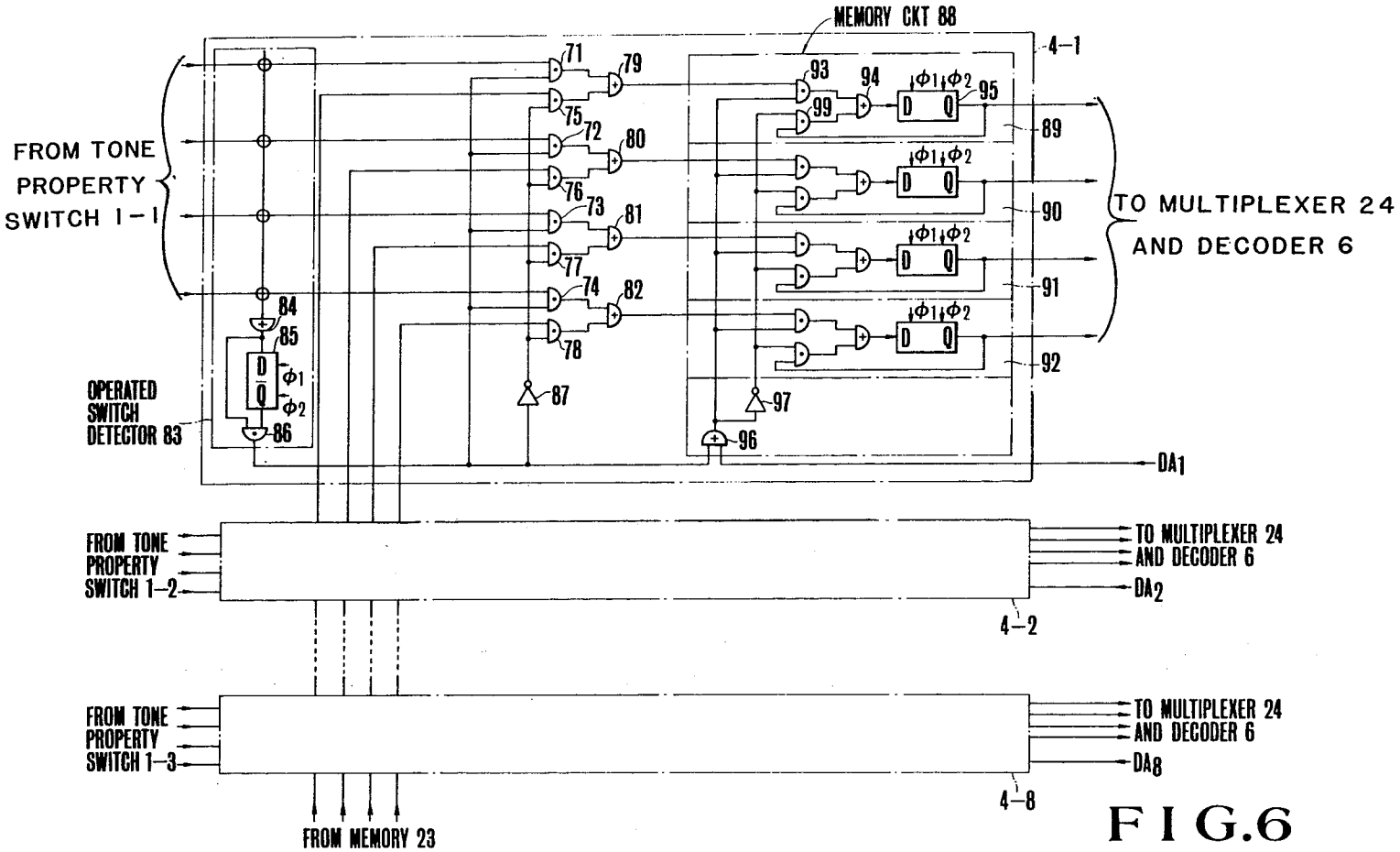
FIG. 6 is a connection diagram showing one example of the tone property register shown in FIG. 1.
Figure 7:
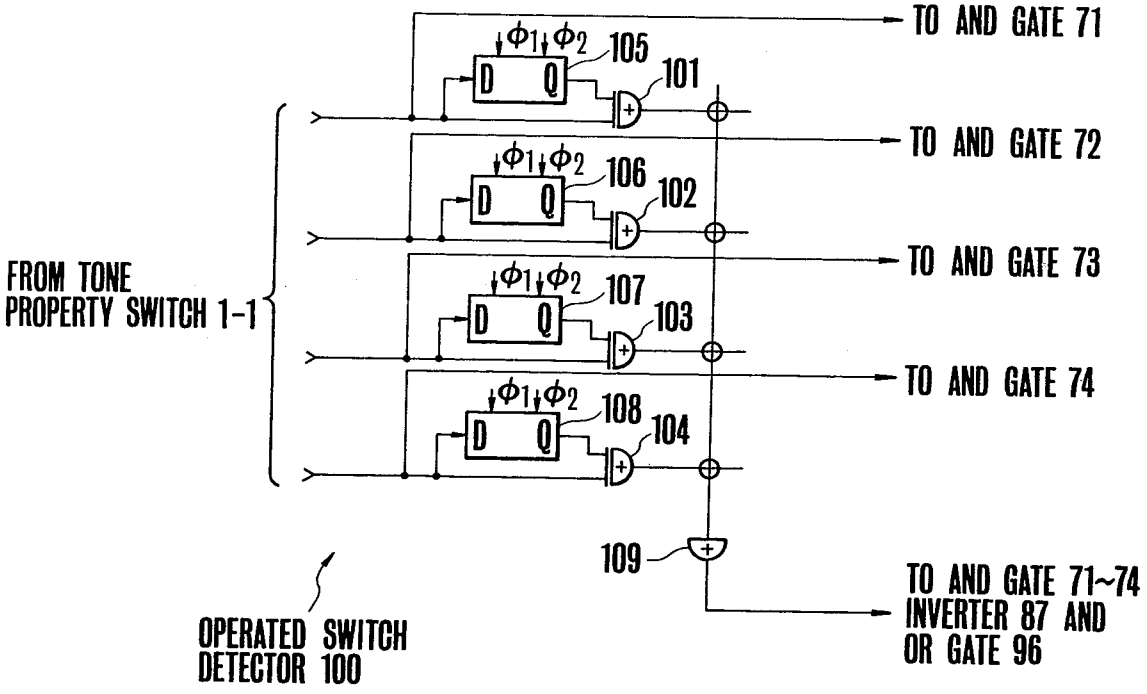
FIG. 7 is a connection diagram showing a modification of the operated switch detector shown in FIG. 7.

The timing signal generator 28 for producing a signal for controlling the writing and reading operations is constructed as shown in FIG. 4. In FIGS. 4, 6 and 7 an AND gate and an OR gate having multiple inputs are depicted as having a single input line and multiple input signal lines crossing the input line and the cross-points are bounded by small circles.

In the example shown in FIG. 4 there is shown a reference generator 29 which produces a reference clock $\phi$ having a predetermined period and a 180° dephased pulse $\phi 1$ and a pulse $\phi 2$ formed upon the reference clock $\phi$. A counter 30 is normally driven by the reference clock $\phi$. In this example, the counter 30 is a 8-bit counter. An AND gate 31 is enabled whenever all bits of the counter 30 become "1", that is whenever the count of the counter reaches 255 to produce an output pulse which is designated hereinafter as T255. In this embodiment, the processing of writing and reading the preset data is performed during one period of the counter 30 (that is a period in which the count of the counter varies from 0 to 255, (hereinafter this period is designated by T) and the times of initiating and terminating the processing are determined by the T255 produced at each period. An AND gate 32 is connected to produce a pulse when the count of the counter 30 reaches 7 and thereafter produce a pulse at each 16 counts. These pulses (hereinafter designated as T16) are used to determine the time for writing into the memory device 23 time division multiplex signals sent from the multiplexer 24. 3 bit signals A0, A1 and A2 respectively appearing at the outputs Q4, Q5 and Q6 of the counter 30 vary their values at each 16 counts of the counter 30 and are used for multiplexing data to be written in the multiplexer 24 and as address signals for reading and writing the memory device 23. Signals DA1 through DA8 outputted from the decoder 33 via AND gate 34-1 through 34-8 are obtained by decoding aforementioned 3-bit signals A0, A1 and A2 which are produced in only one period T in which the data are written into and read out from the memory device 23. The detail of generating these 3-bit signals will be described later.

Figure 5:
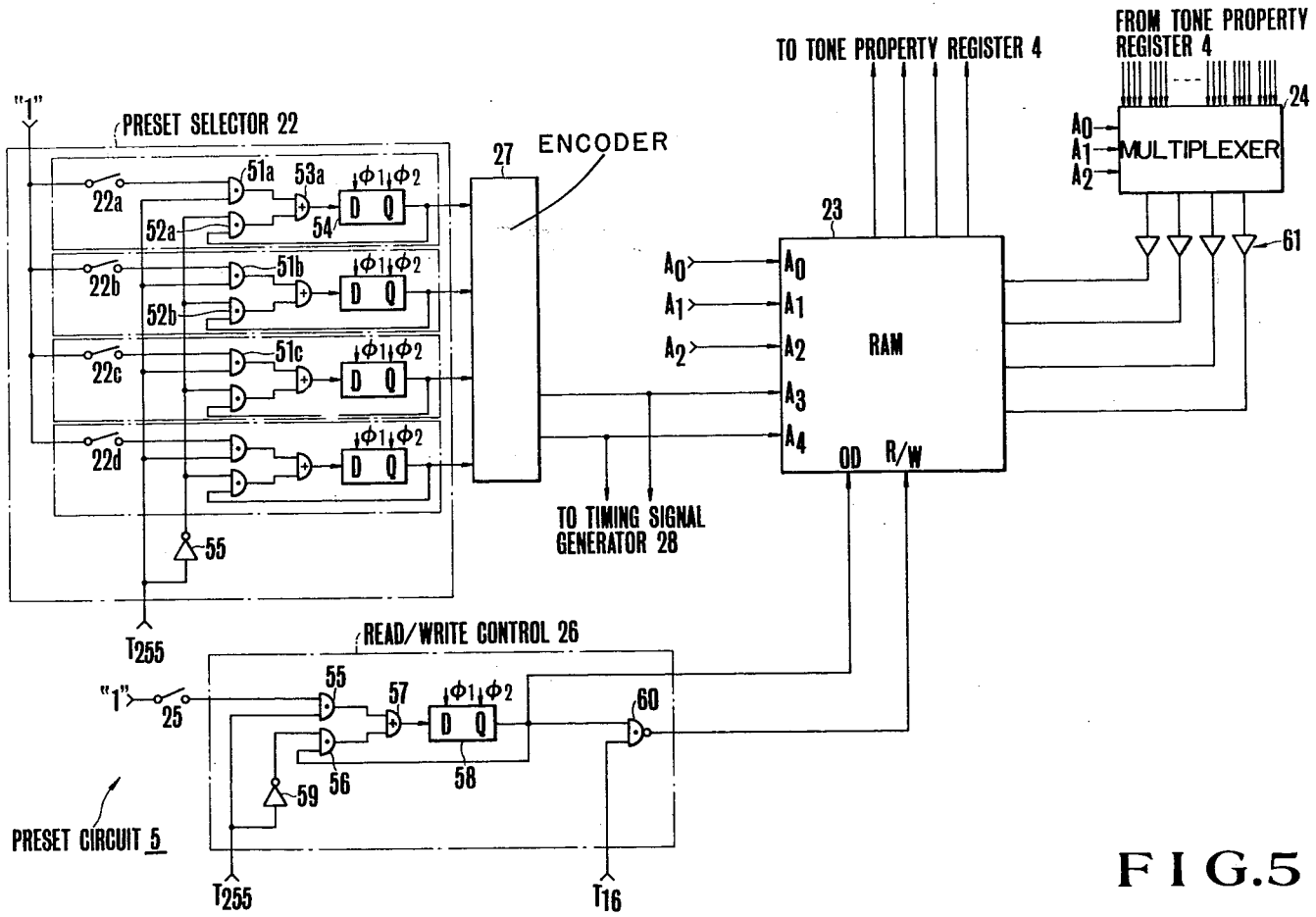
FIG. 5 is a connection diagram showing one example of the preset circuit shown in FIG. 1.

The detail of the preset circuit 5 shown in FIG. 1 is shown in FIG. 5.

The preset selector 22 comprises preset selection switches 22*a* through 22*d* closed by the performer, and a circuit for memorizing the closure of the switches for one period. More particularly, the preset selection switch 22*a* is connected to a delay (D) flip-flop 54 via one input of an AND gate 51 via an OR gate circuit 53 and the output of the D flip-flop 54 is fed back to its input through AND gate 52 and the OR gate 53. The other inputs of the AND gate 51 and 52 are supplied with the signal T255 and an inverted signal thereof obtained by inventing signal T255 by an inverter 55. The D flip-flop 54 is supplied with two phase clock pulses $\phi 1$ and $\phi 2$ so that the D flip-flop 54 delays one bit the signal supplied through the OR gate 53 according to these clock pulses. For this reason, during the closure of the switch 22*a*, when the signal T255 is produced the D flip-flop 54 produces "1" one bit later, and this output "1" is fed back to the input of the D flip-flop 54 via AND gate 52 and OR gate 53 and held in the D flip-flop 54 until the next signal T255 is produced. Thus, upon closure of switch 22*a* the output of the D flip-flop 54 builds up to "1" at the time of starting the succeeding first period T and decreases to "0" at the end of the period T when the switch 22*a* is opened. This delay is necessary because at least one period T is necessary for controlling writing in and reading out of the memory device. Preset selection switches and circuits associated therewith are constructed in the same manner as switch 22*a* and its associated circuits.

The outputs of the D flip-flop 54 corresponding to respective preset selection switches 22*a* through 22*d* are applied to an encoder 27 and converted into 2-bit signals, which are sent to memory device 23 as address signals designating storage areas corresponding to closed ones of the preset selection switches 22*a* through 22*d*.

A read/write control circuit 26 is provided with a circuit that memorizes the closure of a write switch 25 in the same manner as the preset selector 22. More particularly, a signal (which is "1" when switch 25 is closed) from the write switch 25 of the read/write control circuit 26 is applied to the input of a D flip-flop 50 via an AND gate circuit 5 and an OR gate circuit 57, and the output of the D flip-flop 58 is fed back to its input via an AND gate 56 and the OR gate 57. The other inputs of the AND gate 55 and 56 are with the signal T255 and its inverted signal inverted by an inverter 59. As a result, the output of the D flip-flop 58 becomes "1" when the write switch 25 is closed and then a succeeding first period T commences, and reduces to "0" when the switch 25 is opened and the aforementioned period T terminates. Thus, upon closure of the write switch 25, the output of the D flip-flop 58 is maintained at "1" during at least one period T. The output of the D flip-flop 58 is applied to an OD (output disable) terminal so as to prevent the memory device 23 from outputting an output while the output is maintained at "1" (that is during an interval of write mode). Furthermore, the output of the D flip-flop 58 is applied to one input of a NAND gate 60, the other input thereof being connected to receive the pulse T16 which is produced at each 16 counts of the clock pulse $\phi$. Consequently, the output of the NAND gate 60 becomes "0" only when the pulse T16 is generated while the output of the delay flip-flop 58 is "1". The output of the NAND gate 60 is supplied to switch writing and reading operations of the memory device 23. Thus, the output "1" of the NAND gate 60 sets the memory device 23 to a read state, whereas the output "0" sets the memory device 23 to a write state. The reason that the output of the NAND gate 60 is made to be "0" only when the pulse T16 is generated instead of during the closure of the write switch 25 is to without fail write the data sent from the multiplexer 24.

As above decribed, the memory device 23 is used to store the amount of operation of the tone property switches 1-1 through 1-8 of the tone property switch circuit 1. In this embodiment the circuit is constructed to write , on the time division basis, the 8 amounts of operation. Thus, the 8 data held in the tone property register 4 is simultaneously applied to the multiplexer 24 (one data comprises 4 bits) to sequentially produce an output one after one in accordance with the 3 bit signals A0, A1 and A2 at each 16 counts of the clock pulse $\phi$. By using the output of the encoder 27 as the address signal, the memory device 23 sequentially stores the 8-bit data each time the pulse is applied by the NAND gate 60, in which the 3-bit signals A0, A1 and A2 are utilized as the address signals for the storage locations. Conversely, to read out the data, 8 data are successively read out from the storage locations of the memory device 23 designated by the output signal of the encoder 27 by using the 3-bit signals A0, A1 and A2 as the address signals for the storage locations and the read out data are applied to the tone property register 4.

In addition to being used as the address signal of the memory device 23, the output signal of the encoder 27 is also applied to the timing signal generator 28 (FIG. 4) to generate signals DA1 through DA8 mentioned above. More particularly, variation in the output signal of the encoder 27 is detected to detect either one of closed preset selection switches **22*a* through 22*d* so as to generate signals DA1-DA8. Thus, the output of the encoder 27 is used to switch the output of the tone property register 4 between the output (manually operated data) of the tone property circuit 1 and the output (preset data) of the memory device 23. These operations will be described with reference to FIG. 4. Thus, when a 2-bit signal (that is a signal showing that one of the preset selection switches 22*a* through 22*d* is being closed) produced by the encoder 27 is supplied to a preset variation detector 35 which detects variation in the input signal and comprises EXCLUSIVE-OR gate 37 and 39 corresponding to respective bits. Each EXCLUSIVE-OR gate is connected to receive each bit signal and a signal produced by delaying one bit the bit signal by a D flip-flop 36 or 38. As a consequence whenever either one of the bit signals vary either one of the EXCLUSIVE-OR gate 37 and 39 would produce a pulse. The outputs of these OR gate 37 and 39 are outputted from the preset variation detector 35 through an OR gate 40. When one of the preset selection switches 22*a* to 22*d* is operated, at least one of the two bits (the output of the encoder 27) varies, so that whenever one of the switches is operated one pulse would be produced from the OR gate 40. This pulse is applied to a D flip-flop 42 via an OR gate 41 and the output of the D flip-flop 42 is fed back to its input via an AND gate 43 and the OR gate 41. A signal obtained by inverting the signal T255 with an inverter 44 is applied to the other input of the AND gate 43. Consequently, when a pulse is produced by the preset variation detector 35 (since the output of the preset selection switch circuit 22 builds up at the commencement of the period T, this pulse is produced in synchronism with the commencement of the period T) a signal "1" would be held by a loop including the D flip-flop 42, AND gate 43 and the OR gate 41** for nearly one period T.

An AND gate 45 is connected to receive the signal in this loop and the signal T16 described above to pass the same while signal "1" is held in the loop. A decoder 33 is provided to decode the 3-bit signal A0, A1 and A3 and the decoded signals are applied to one input of AND gates 34-1 through 34-8 respectively, the other inputs thereof being supplied with the output of the AND gate 45. As a consequence, the outputs of the decoder 33 can pass through the AND gates 34-1 through 34-8 during one period T. Although the outputs of the decoder are sequentially switched from DA1 to DA8, since the speed of switching is equal to 16 counts of the clock pulse, the switching is effected from DA1 to DA6 during an interval (127 counts of the clock pulses) which is equal to one half of the period T. Accordingly, during an interval (that is one period T) in which the AND gates 34-1 through 34-8 are enabled, outputting operation of the signals DA1 through DA8 is repeated twice.

The signals DA1 through DA8 sequentially outputted from the AND gate circuits 34-1 through 34-8 are applied to the tone property register 4.

The detail of one example of the tone property register 4 is shown in FIG. 6. The tone property register 4 comprises registers 4-1 through 4-8 (4-3 through 4-7 are not shown) corresponding to the tone property switches 1-1 through 1-8. However, since the registers have the same construction, in FIG. 1 one of them, i.e., 4-1 will be decribed in detail.

This register 4-1 is used to store and hold the data regarding the tone color of a flute 16'. Thus, the register 4-1 is constructed to apply manually operated 4-bit data sent from the tone property switch 1-1 to one input of AND gates 71 through 74, respectively and to apply 4-bit preset data sent from the memory device 23 to one input of AND gate circuits 75 through 78. In this invention for the purpose of preferentially controlling the manually operated data produced by the tone property switch 1 the circuit is constructed such that the AND gate 71 through 74 and 75 through 78 are controlled in accordance with the operation of the tone property switch 1-1. An operated switch detector 83 is provided for detecting the operation of the switch 1-1 for the purpose of controlling these AND gates 71 through 78. Thus, as shown in FIG. 6, the operated switch detector 83 comprises an OR gate 84 connected to receive the 4-bit data from the tone property switch 1-2, a D flip-flop 85 supplied with the output of the OR gate 84 and an AND gate 86 with one input connected to the output Q of the D flip-flop 85 and the other input connected to receive the output of the OR gate 84. The output of the AND gate 86 is applied to the other inputs of the AND gates 71 through 74 and to the other inputs of AND gate circuits 75 through 78 via an inverter 87. Consequently, when the tone property switch 1-1 is not operated, the output of the operated switch detector 83 is "0", whereby the AND gate 75 through 78 are enabled to take out therefrom the output data of the memory device 23. When the tone property switch 1-1 is closed (when it is opened, the 4-bit data are all "0"), the operated switch detector 83 produces a pulse, whereby the AND gates 71 through 74 are enabled to produce the data from the switch 1-1. In other words, a priority circuit is formed such that under the normal state, the data from the memory device 23 are derived out, but upon closure of the switch 1-1 the data therefrom is preferentially taken out. The outputs of the AND gate 71 and 75; 72 and 76; 73 and 77; and 74 and 78 are taken out respectively through OR gate 79, 80, 81 and 82.

A memory circuit 88 in the register 4-1 is used to store and hold the 4-bit data sent from the OR gate 79 through 82 and is provided with circuits 89 through 92 corresponding to respective bits. Describing the circuit 89 supplied with the output of the OR gate 79, the output thereof is applied to a D flip-flop 95 via an AND gate 93 and an OR gate 94, while the output of the D flip-flop circuit 95 is fed back to its input via an AND gate 99. The signal DA1 and the output signal of the operated switch detector 83 are applied to the other input of the AND gate 93 and to the other input of the AND gate 99 via an inverter 97. Circuits 90 to 92 relating to the other bits are constructed in the same manner as above described. Consequently, upon closure of the tone property switch 1-1 the AND gate 93 is enabled, and at this time, since the data from this switch 1-1 are outputted from the OR gate 79 through 82, the data from the switch would be applied to the OR gate 94 via the AND gate 93 so that the data would be stored in a loop including the D flip-flop 95, the AND gate 99 and the OR gate circuit 94.

Where preset selection switches 22*a* through 22*d* of the preset selector 22 are closed, signal DA1 is produced as above described so that the AND gate circuit 93 is enabled. At this time, however, as the operated switch detector 83 is "0", the data from the memory device 23 are applied to the AND gate 93 via the OR gate 79 through 82.

As above described the data from the memory device 23 are multiplexed with regard to tone colors and effects, but since the AND gate 93 is enabled by signal DA1 only when the preset data regarding the tone color of the flute 16' system is read out. Accordingly, only the preset data regarding the flute 16' can pass through the AND gate 93. The data outputted by the AND gate 93 is applied to the OR gate 94 and then stored in the loop circuit comprising the D flip-flop 95, AND gate 99 and the OR gate 94.

Moreover, while the preset data from the memory device 23 is being stored when the tone property switch 1-1 is opened and then closed again (at this time the output of the detected switch circuit 83 becomes "1"), the content of the memory circuit can be rewritten with to the data from the tone property switch 1-1.

Although in the foregoing description, a register 4-1 corresponding to the tone color of the flute 16' has been described, registers 4-2 through 4-8 (registers 4-3 through 4-7 are not shown) corresponding to the other tone colors and effects are also constructed similarly. Accordingly, upon operation of the tone property switches 1-1 through 1-8, registers 4-1 through 4-8 respectively store manually operated data corresponding to the extent of the operation, whereby the color and effect of the produced musical tone are controlled in accordance with the data. Where preset selection switches 22*a* through 22*d* are closed, preset data are sequentially read out from the memory device 23 and these data are demultiplexed by signals DA1 to DA8 and the demultiplexed data are sequentially stored in registers 4-1 through 4-8 respectively, and the tone color and effect of the musical tone are controlled in accordance with the stored data. When either one of the tone property switches 1-1 through 1-8 is operated, while the musical tone is being controlled according to the preset data from the memory device 23, the content of one of the registers 4-1 through 4-8 corresponding to the manually operated switch is changed to the manually operated data. Accordingly, the preset data now being read out from the memory device 23 would be modified.

In FIG. 6, since the operated switch detector 83 produces a detected signal only when the tone property switch 1-1 (1-2 through 1-8) is operated from OFF (all 4-bit data are "0"), for the purpose of changing the data from the memory data being stored in register 4-1 (4-2 through 4-8) to the manually operated data of the switch 1-1 (1-2 through 1-8), it is necessary to operate it again after opening the same. However, it becomes unnecessary to be the switch if the circuit is constructed as shown in FIG. 7. Thus, an operated switch detector 100 shown in FIG. 7 comprises EXCLUSIVE-OR gates 101 through 104 corresponding to 4-bit data supplied from tone property switch 1-1 (1-2 through 1-8). The inputs of these EXCLUSIVE-OR gates 101 through 104 are supplied with respective bit signals while the other inputs are supplied with bit signals delayed by D flip-flop 105 through 108. All outputs of the EXCLUSIVE-OR gates 101 through 104 are applied to the input of the OR gate 109. Consequently, when the value of only one bit of the 4-bits of the manually operated data varies, the OR gate 109 produces a pulse and the content of the memory circuit 88 is changed to the manually operated data. Thus, it is possible to modify the contents of the registers 4-1 (4-2 through 4-8) without returning the tone property switch 1-1 (1-2 through 1-8) to OFF.

As above described, according to this invention, it is possible to provide a manual priority control. Accordingly, in an electronic musical instrument capable of controlling a musical tone by a manual operation of the tone property switch and controlling the musical tone by using preset data, when the tone property switch is operated while performing the control according to the preset data, values set by such manual setting elements as the tone property switches are sent out instead of the preset data. Such values are not variation, and any variation is not added to the preset values as in the prior art so that the control can be readily made as desired by the operator. Furthermore, the manually set values can be confirmed visually with the aid of the display device. When a musical tone is performed according to the preset value displayed by the display device it is possible to manually set while anticipating the modified state of the musical tone to be formed based on a manually set value to be switched.

It should be understood that the invention is not limited to the embodiment described above and that many changes and modifications may be made without departing from the true spirit and scope of the invention.

Figure 2:
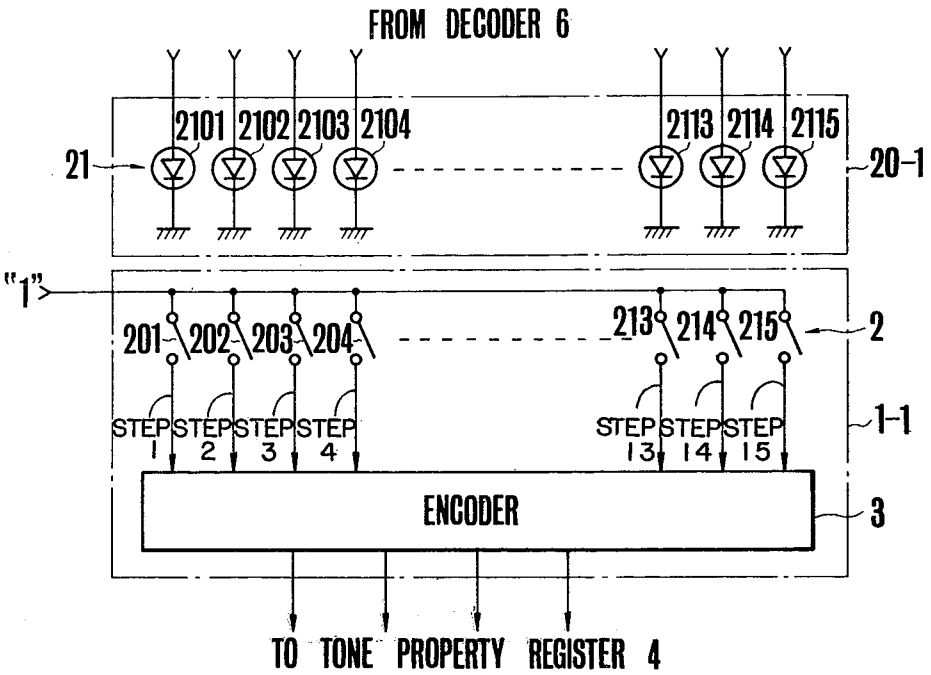
FIG. 2 is a connection diagram showing one example of the tone property switches and the display device shown in FIG. 1.

For example, in the embodiment shown in FIG. 2, the tone property switch is arranged independently of the display but tone property switch may be of the type having a display lamp. In this type, however, contacts of the switch restore the original state in the absence of operational force.

Figure 8:
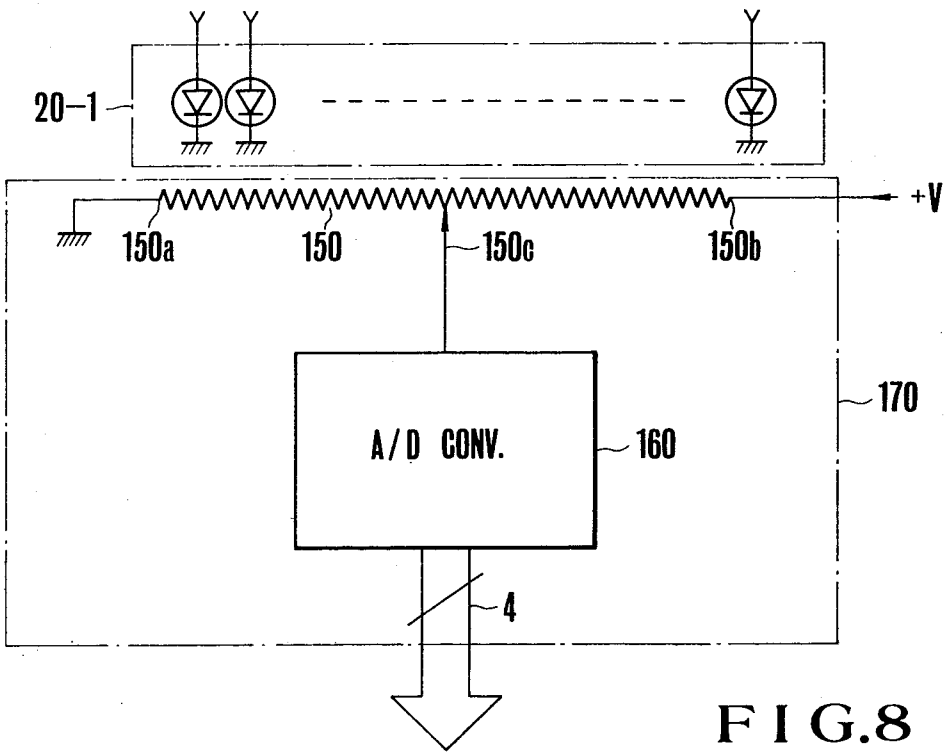
FIG. 8 is a connection diagram showing a modification of the tone property switches shown in FIG. 2.

Further, in the embodiment shown in FIG. 2, the manually set values of such component elements of a musical tone to be formed as the tone color and effect were transferred by a switch, but the same operation can be made by using a combination of a variable resistor 150 and an analogue to digital converter 160 as shown in FIG. 8. Thus, the opposite ends 150*a* and 150*b* of the variable resistor 150 are respectively connected to ground and to a voltage source of +V, while the variable tap 150*c* is connected to an analogue to digital converter 160. Accordingly, by manually moving the variable tap 150*c* it is possible to derive out a digital output from the converter 160 corresponding to the voltage at the variable tap. This manual setting device 170 corresponds to the switch 1-1 shown in FIG. 2. Lamps 2101 through 2115 in FIG. 8 (see FIG. 2) are provided to be driven by the outputs of the device 170 corresponding to the manually set amounts.

A set of display elements is provided corresponding to the manually set elements for selectively displaying the set amounts of the elements or only the corresponding preset values.

What is claimed is:

1. An electronic musical instrument capable of presetting data relative to a musical tone to be produced by an instrument comprising:

keyboard means having a plurality of keys;

mode selection means for manually selecting either one of a write mode and a read mode;

memory means for storing preset data corresponding to component elements of a musical tone prior to the write mode being selected by said mode selection means;

register means connected to said memory means for receiving and storing therein said preset data of said memory means when the read mode is selected by said mode selection means;

manual setting means having a plurality of manual setting elements for generating corresponding manual data, said manual setting elements corresponding to a respective one of said component elements;

detecting means for detecting the fact that one of said manual setting elements has been operated in the read mode and for generating a detection signal representing said fact, said register means adapted to replace said preset data with data corresponding to the operated manual setting elements; and producing means connected to said register means for producing a musical tone in accordance with the content of said register means and a note signal sent from said keyboard means.

2. An electronic musical instrument according to claim 1 which further comprises a display device for displaying the output of said register means.

3. An electronic musical instrument according to claim 1 wherein each of said manual setting elements is a switch adapted to restore an original state in the absence of operational force.

4. An electronic musical instrument according to claim 3 wherein said switch includes a display lamp for displaying the output of said register means.

5. An electronic musical instrument according to claim 1 wherein each of said setting elements comprises a variable resistor.

6. An electronic musical instrument according to claim 1 wherein each of said setting elements comprises a multiplexing switch.

7. An electronic musical instrument according to claim 1 wherein said preset memory device prestores a plurality of sets, each of which includes component elements of the musical tone to be produced, and said register means further includes a plurality of selection switches and means for selecting one of said sets in accordance with operation of one of said selection switches.

8. An electronic musical instrument comprising:

a keyboard having a plurality of keys;

manual setting means including a plurality of switches for manually controlling amounts of component elements of a musical tone to be produced;

display means including a plurality of display elements corresponding to said switches;

memory means for storing signals from said switches as a component element control signal of the musical tone;

preset memory means for prestoring said component element control signal;

means for producing a musical tone in accordance with an output of said memory means and a note signal sent from said keyboard;

means for detecting the operation of one of said plurality of switches;

means for substituting the contents of said memory means corresponding to the component element of an operated switch with a manually set value from the operated switch;

means for substituting the contents of said preset memory means with the output of said memory means;

means for transferring the contents of said memory means to said display means.

9. An electrical musical instrument according to claim 8 wherein each of said switches are adapted to restore an original state in absence of operational force.

10. An electronic musical instrument according to claim 8 wherein said switch includes one of said display elements.

11. An electronic musical instrument according to claim 8 wherein said manual setting means includes a plurality of groups of said switches.

12. An electronic musical instrument according to claim 8 wherein said preset memory device stores a plurality of sets of the component element control signals of the musical tone to be produced and wherein said electronic musical instrument further comprises a selector for selecting said sets.

13. An electronic musical instrument according to claim 8 which further comprises means arranged between said manual setting means and said memory means for encoding signals from said switches.

* * * * *